US008540102B2

(12) United States Patent
Taylor

(10) Patent No.: US 8,540,102 B2
(45) Date of Patent: Sep. 24, 2013

(54) DRUM RING AND LEVER SYSTEM

(75) Inventor: Dale W. Taylor, Hamilton, IN (US)

(73) Assignee: American Flange & Manufacturing Co., Inc., Carol Stream, IL (US)

( * ) Notice: Subject to any disclaimer, the term of this patent is extended or adjusted under 35 U.S.C. 154(b) by 863 days.

(21) Appl. No.: 12/455,114

(22) Filed: May 28, 2009

(65) Prior Publication Data

US 2009/0294449 A1 Dec. 3, 2009

Related U.S. Application Data

(60) Provisional application No. 61/056,969, filed on May 29, 2008.

(51) Int. Cl.
*B65D 45/34* (2006.01)

(52) U.S. Cl.
USPC ..... 220/321; 292/256.69

(58) Field of Classification Search
USPC ..... 215/275, 286, 284; 220/321, 320, 220/686; 292/265.65, 265.69, DIG. 11, DIG. 49

See application file for complete search history.

(56) References Cited

U.S. PATENT DOCUMENTS

| | | | | |
|---|---|---|---|---|
| 4,194,772 | A | 3/1980 | Hurd | |
| 4,678,216 | A | 7/1987 | Gregory | |
| 5,129,537 | A | 7/1992 | Bordner | |
| 5,713,482 | A | 2/1998 | Bordner | |
| 5,947,320 | A * | 9/1999 | Bordner et al. | 220/321 |
| 7,243,962 | B2 | 7/2007 | Stolzman | |
| 7,497,489 | B2 * | 3/2009 | Baughman et al. | 292/256.65 |
| 7,802,827 | B2 * | 9/2010 | Easterday et al. | 292/256 |

* cited by examiner

*Primary Examiner* — Robin Hylton
(74) *Attorney, Agent, or Firm* — Baker Hostetler LLP

(57) ABSTRACT

A two piece clamping ring and lever system for retaining removable lids to containers comprises a split circular ring. The ring first end includes outwardly extending receiving hooks. The second end of the ring includes pivot bosses comprising a pivot shaft and enlarged button. A lever with pivot shafts engages with the ring first end. When the lever is closed contact surfaces on an inwardly projecting transverse beam on the underside of the lever and outwardly projecting beams on the ring first end engage to relieve stresses on the lever pivot shafts and ring first end pivot receiving hooks. A second stress transfer relationship is engaged as an inwardly facing transverse beam extending between the sidewalls of the second end is slideably engaged into corresponding receiving channels outwardly facing from the ring first end thereby relieving stresses on the pivot bosses and corresponding longitudinally extending lever bearing surface.

12 Claims, 7 Drawing Sheets

DRUM RING AND LEVER SYSTEM

CROSS-REFERENCE TO RELATED APPLICATIONS

This application claims the benefit of provisional patent application Ser. No. 61/056,969, filed May 29, 2008 by the present inventor.

FIELD OF THE INVENTION

This invention relates to lidded container sealing systems and, more particularly, to a two piece polymeric clamping ring assembly for securing a lid to a container.

BACKGROUND OF THE INVENTION

A wide variety of materials are stored and or transported in lidded containers, where the lid is secured to the container with a clamping ring. A number of different container, lid, and clamping ring configurations have been employed.

Originally lids were secured on containers with clamping rings made of metal construction, having a generally U-shaped cross-section. However, these metal clamping rings are prone to corrode, or when painted the paint is prone to flake off, leaving particles of contamination within the container contents.

Thereafter, clamping rings of a thermoplastic construction were designed for the clamping of lids on containers without the concern for particulate contamination to the container contents. U.S. Pat. No. 4,678,216 to Gregory (1987) discloses a three piece thermoplastic clamping ring having a U-shaped cross-section, a clamping link, and a pivotable clamping lever; however, these clamping rings were not cost competitive with metal clamping rings meeting similar container performance criteria. U.S. Pat. No. 5,129,537 to Bordner (1992) discloses a two piece polymer clamping ring designed for use in securing a lid to a fiber container; however, when this design was employed to secure plastic lids on plastic containers, excessive stress was imposed upon the pivot shaft or pin integrally formed upon the pivot arm of the clamping system which caused the system to fail. U.S. Pat. No. 5,713,482 to Bordner (1998) discloses a lower profile two piece polymer clamping ring designed to provide a more secure union between the container and the lid than the previous Bordner design when used on fiber or plastic containers; however, this clamping system having a similar design in the pivot shaft or pin integrally formed upon the pivot arm of the clamping system is prone to fail in a similar fashion as the previous design.

Conventional designs include transverse molded pivot shafts on both the clamping ring and the pivot arm or lever. During the injection molding process these transverse molded pivot shafts are typically the last point where the polymer fills the mold. Because of the symmetrical nature of the clamping ring and lever, the polymer will fill the pivot shaft from both sides leaving a knit-line in the center of the pivot shaft. This knit-line is typically weaker than the surrounding polymer and may fracture under stresses induced as the lever is closed drawing the two ends of the clamping ring tight around the container and lid assembly, or fail as a result of stresses induced when the container is tipped or dropped.

Another common feature of these designs includes a receiving notch integrally molded to the clamping ring that receives the transverse molded pivot shaft. The receiving notch is generally C shaped and is prone to opening up under stress thereby allowing the pivot arm to disengage and the system will fail to clamp the lid to the container with sufficient force. U.S. Pat. No. 5,713,482 to Bordner (1998) discloses a stress transfer relationship between the two ends of the ring designed to relieve excess stress from the pivot arm and receiving notch interface; however, these features do not sufficiently engage each other to provide the required stress transfer to eliminate the breakage of the pivot arm or bending of the receiving notch in similar stress environments to those described above.

In one form of the conventional two piece polymer clamping ring assemblies, the pivot arm or lever has a cover portion extending over the receiving portion of the ring pivot shaft that is thermally or ultrasonically welded shut after assembly of the lever to the clamping ring. This feature is designed to secure the pivot shaft to the lever while allowing the two components to maintain a slideable relationship as the lever is opened and closed. The secondary plastic welding operation required to secure the two components together adds manufacturing cost to the assembly.

The present invention is directed at solving one or more of the problems discussed above in a novel and simple manner.

SUMMARY OF THE INVENTION

The present invention discloses a two piece polymer clamping ring and lever system for retaining removable lids to containers. While providing the advantages of polymer ring attributes to mitigate contamination seen in metal counterparts, the system is easy to assemble without the addition of secondary equipment such as welding required to securely retain the ring pivot shaft in the lever.

In a preferred embodiment the polymeric clamping ring assembly is able to withstand greater stresses than conventional designs without breaking or yielding due to a combination of the nesting feature of the ring second end over the lever, the nesting of the lever over the first end of the ring, and the ability of the pivot bosses joining the second end of the ring to the lever to move independent of one another as the container is tipped over or dropped on the ring. The independent nature of the pivot bosses allows them to move with the container impact and return to their original shape without fracturing in a similar mode to the conventional transverse molded pivot shafts.

Another feature of the invention is to provide a two piece polymer clamping ring and lever system for retaining removable lids to containers. The clamping ring comprises a split circular ring, having an inwardly opening generally U-shaped channel formed of polymeric material, having first and second ends, an outer circumferential wall and oppositely disposed inwardly facing sidewalls. The ring first end including a plurality of outwardly extending receiving hooks, a plurality of outwardly facing receiving channels, and a plurality of outwardly extending stress transfer beams. The ring has an oppositely disposed second end including a flared region with mutually inwardly facing internal surfaces slideably moveable in adjacency over the outwardly facing side surfaces of the lever. The inwardly facing sidewalls of the second end of the ring include an inwardly facing transverse beam extending between the sidewalls and inwardly extending pivot bosses comprising of a pivot shaft and enlarged button. A lever having an inwardly opening generally U-shaped channel form having mutually inwardly facing internal surfaces slideably moveable in adjacency over the side surfaces of the ring first end. The lever having a pivot end formed with a plurality of pivot shafts inwardly extending from the spaced apart sides of the lever to a pivot beam longitudinally disposed about the center of the lever underside, and a plurality of ring pivot boss receiving windows projecting through oppositely disposed lever sidewalls having pivot boss access openings extending to pivot shaft bearing surfaces spaced from the lever pivot shafts a distance selected for drawing together the ring first and second ends. The lever having an inwardly extending transverse beam between the spaced apart sides rearward of the pivot boss access opening. The lever pivot shafts are configured for pivotable engagement with the ring first end receiving hooks and the lever receiving windows are configured for slideably receiving the ring second end pivot bosses. Movement of the lever from a generally radial position to a generally tangential position during closing of the lever constricts the ring trapping the lid and container flanges in the U-shaped split ring channel.

It is another feature of the invention that the movement of the lever from a generally radial position to a generally tangential position during closing of the lever engages a first stress transfer feature between a transverse beam extending between spaced apart sidewalls of the lever underside and a plurality of outwardly facing beams on the first end of the ring. This feature transfers stresses from the lever pivot shafts and the corresponding ring first end receiving hooks.

It is another feature of the invention that the movement of the lever from a generally radial position to a generally tangential position during closing of the lever engages a second stress transfer feature between a transverse beam extending between spaced apart sidewalls of the second end of the ring underside and a plurality of outwardly facing receiving channels on the first end of the ring. This feature transfers stresses from the ring second end pivot bosses and the corresponding lever receiving windows.

Other objects of the present invention will in part be obvious and will in part appear hereinafter.

The invention accordingly comprises the apparatus possessing the construction, combination of elements, and interrelationships that are exemplified in the following disclosure and the accompanying drawings.

BRIEF DESCRIPTION OF THE DRAWINGS

A fuller understanding of the nature and objects of the present invention will become apparent upon consideration of the following detailed description, taken in connection with the accompanying drawings, wherein:

Drawings—Figures

FIG. 10 is a top view of the lever component of the invention;

DRAWINGS—REFERENCE NUMERALS

Figure 1:
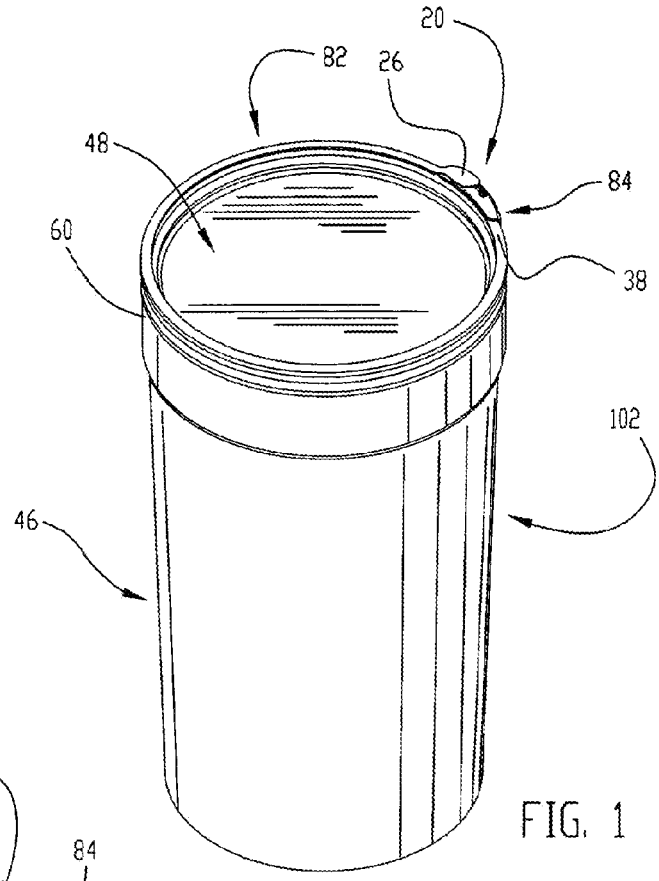
FIG. 1 is a perspective view of a container including a container, lid and clamping ring according to the invention.

20 two piece clamping ring assembly
22 U-shaped channel
24 ring first end pivot receiving hook—first
25 ring first end pivot receiving hook—second
26 ring second end (flared end)
28 ring lockpin lug—first
29 ring lockpin lug—second
30 lever pivot boss access opening—first
31 lever pivot boss access opening—second
32 pivot button—first
34 pivot boss shaft—first
36 lever pivot boss bearing surface—first
37 lever pivot boss bearing surface—second
38 first end of ring
40 lever pivot shaft—first
42 lever pivot shaft—second
43 pivot boss shaft—second
44 pivot button—second
46 container
48 lid
50 flexible gasket
52 annular lid rim
54 container upper contact surface
56 lid outer circumferential sidewall
58 container rim edge
60 container sidewall
62 Lever pivot boss—first
63 Lever pivot boss button—first
64 Lever pivot boss—second
65 Lever pivot boss button—second
66 ring second end sidewall—second
68 ring second end sidewall—first
70 ring lockpin lug aperture—first
72 ring lockpin lug aperture—second
76 ring pivot receiver opening—first
77 ring pivot receiver opening—second
78 lever sidewall—second
80 lever sidewall—first
82 ring object
84 lever object
86 lever pivot boss receiving window—first
88 lever pivot boss receiving window—second

90 lever lockpin aperture
92 container groove
94 ring inner circumferential wall
96 ring upper sidewall
98 ring lower sidewall
100 container rim side surface
102 container assembly
104 container assembly rim structure
106 lever pivot boss alignment—first
108 lever pivot boss alignment—second
110 lever longitudinal pivot beam
112 lever detent ribs—first
114 lever detent ribs—second
116 ring detent ribs—first
118 ring detent ribs—second
120 lever transverse stress transfer rib
122 ring stress transfer beam—first
124 ring stress transfer beam—second
126 ring transverse stress transfer beam
128 ring stress transfer receiving channel—first
130 ring stress transfer receiving channel—second
132 ring first end cutaway
134 ring second end cutaway

DETAILED DESCRIPTION OF THE INVENTION

Figure 2:
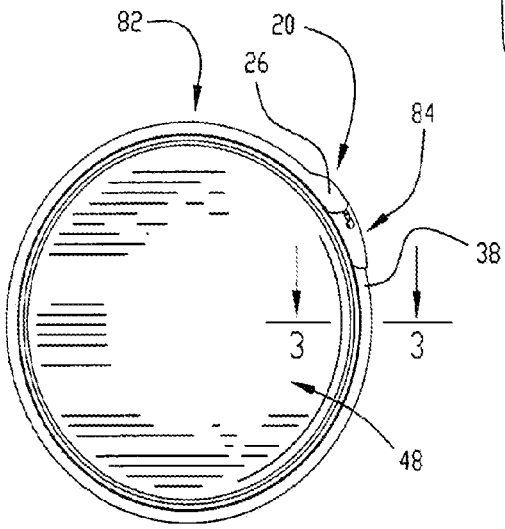
FIG. 2 is a top view of the container assembly of FIG. 1.
Figure 3:
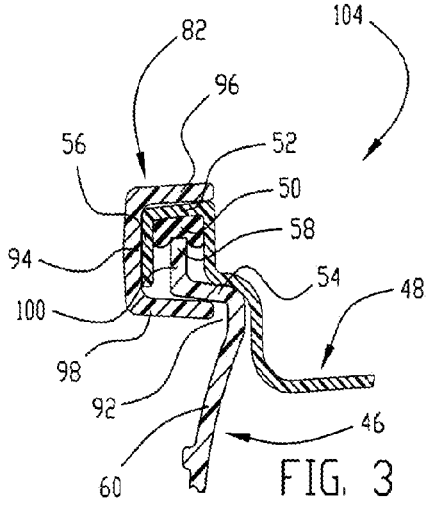
FIG. 3 is a partial sectional view taken through the plane 3-3 in FIG. 2.

In the illustrated embodiment of the invention, as shown in FIGS. 1-3, an assembly comprised of a polymer container, a lid and a polymer two piece clamping ring is revealed generally at 102. The container 46 is of one piece blow molded construction configured such that the sidewalls slightly taper inwardly at the bottom and having an annular end portion defining a top opening. The upper portion of the container is configured having an integrally formed, outwardly disposed upper sidewall 60 which transitions to an inwardly extending engaging region or groove 92 having an upper contact surface 54 seen in the cross sectional view of the container assembly rim or chime structure shown in FIG. 3. Container 46 is depicted as being closed by a lid 48, typically formed of a polyolefin material, and secured to the rim structure 54 of the container 46 by a two piece polymer clamping ring assembly represented generally at 20. FIG. 2 shows the top view of the container assembly represented generally at 102.

The rim structure of the container assembly 102 is shown in general at 104 in FIG. 3. Container 46 having an integrally formed, outwardly disposed upper sidewall 60 which transitions to an inwardly extending engaging region or groove 92 having an upper contact surface 54. The container rim structure is further configured to define an upwardly extending side surface 100 which extends upwardly in a circumferential fashion to form an upwardly disposed rim edge 58. The underside of the annular lid rim 52 captures a flexible gasket 50 and is seen to be nested over the container rim edge 58. Flexible gasket 50 is made from a suitable rubber, polymer, or urethane material such that it compresses and seals the container assembly when sandwiched between the underside of the annular lid rim 52 and the upper edge of container rim edge 58.

FIGS. 1-3 depict certain elements of the two piece clamping ring assembly 20 which are discussed in detail later herein. The two piece clamping ring represented generally at 20 in the closed position, is comprised of a split circular ring 82, having an inwardly opening generally U-shaped channel formed of polymeric material having first and second ends and including an outer circumferential wall 94, two oppositely disposed inwardly facing sidewalls, the upper wall 96 and the lower wall 98. Lever 84 is pivotably engaged to the ring 82 first end 38 and slideably engaged to the ring 82 second end 26. Movement of the lever from a generally radial position to a generally tangential position during closing of the lever constricts the ring sidewall 94 against the lid skirt sidewall 56 while the ring lower sidewall 98 and upper sidewall 96 draw the container upper contact surface 54 and the lid rim 52 together to provide compression on flexible gasket 50.

Figure 4:
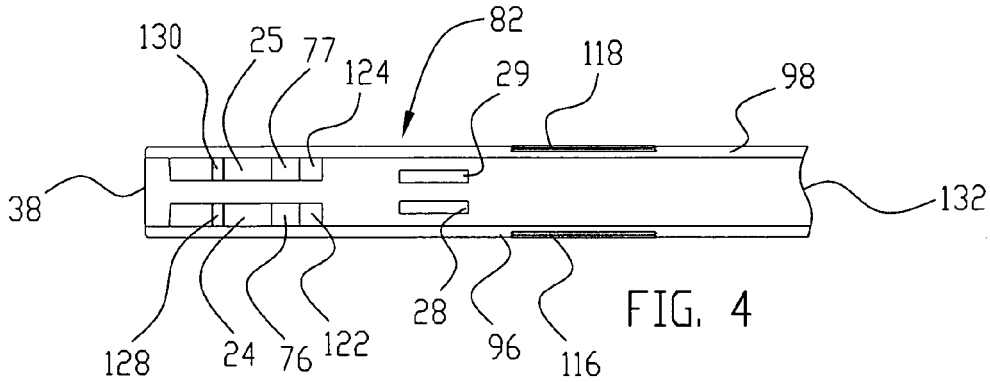
FIG. 4 is a top view of the pivot end of the clamping ring component of the invention.
Figure 5:
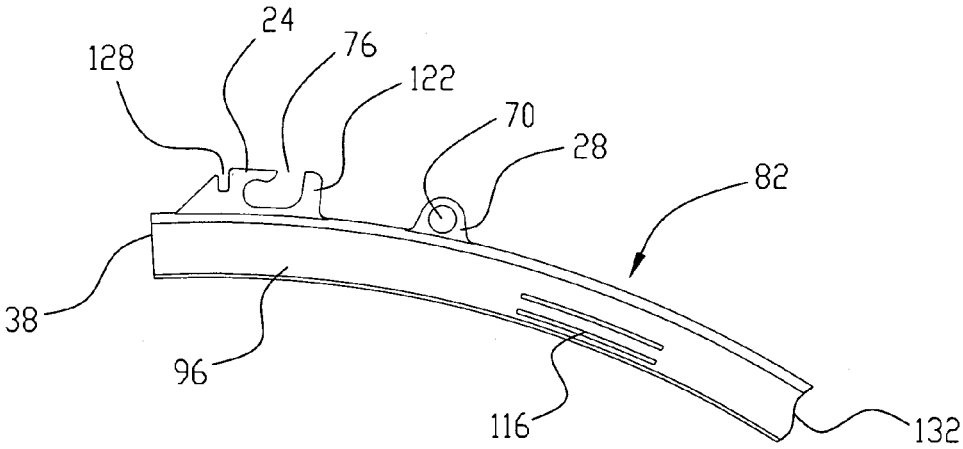
FIG. 5 is a side view of the pivot end of the clamping ring component of FIG. 4.
Figure 6:
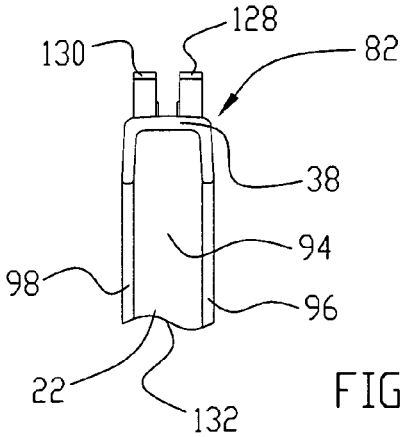
FIG. 6 is an end view of the pivot end of the clamping ring component of FIG. 4.

FIGS. 4-6 illustrates the top, side and end views of ring 82 first end 38. Ring first end 38 having a first outwardly extending pivot receiving hook 24 with a first receiving channel 128 and an outwardly extending stress transfer beam 122 rearwardly spaced from hook 24 leaving pivot receiver opening 76. Ring first end 38 also having a second outwardly extending pivot receiving hook 25 with a second receiving channel 130 and an outwardly extending stress transfer beam 124 rearwardly spaced from hook 25 leaving pivot receiver opening 77. A first outwardly extending lockpin lug 28 having lockpin lug aperture 70 and a second outwardly extending lockpin lug 29 having lockpin lug aperture 72 are shown in FIG. 4. A first pair of detent ribs 116 projecting outwardly from ring 82 sidewall 96 is shown in FIG. 5. A second pair of detent ribs 118 projects outwardly in similar fashion from ring 82 sidewall 98 as shown in FIG. 4.

Figure 7:
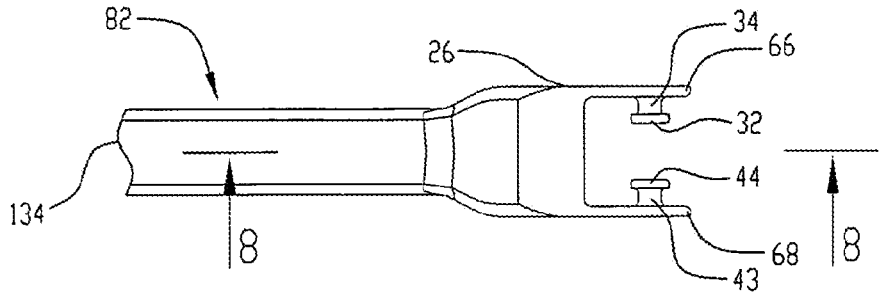
FIG. 7 is a top view of the flared end of the clamping ring component of the invention.
Figure 8:
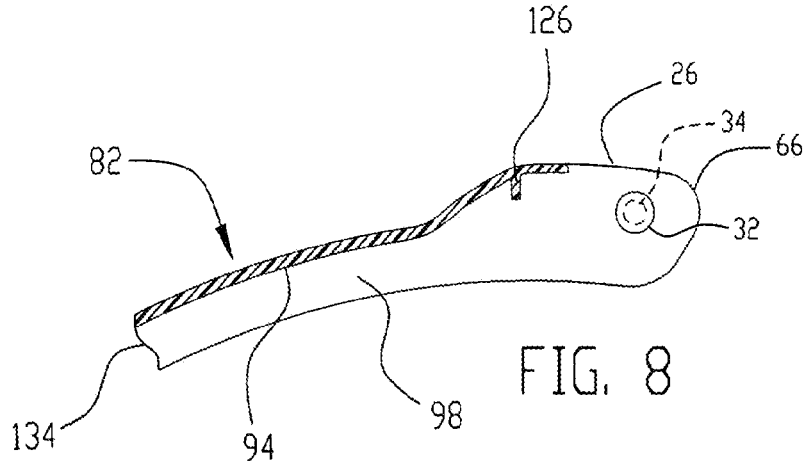
FIG. 8 is a sectional view taken through the plane 8-8 of FIG. 7.
Figure 9:
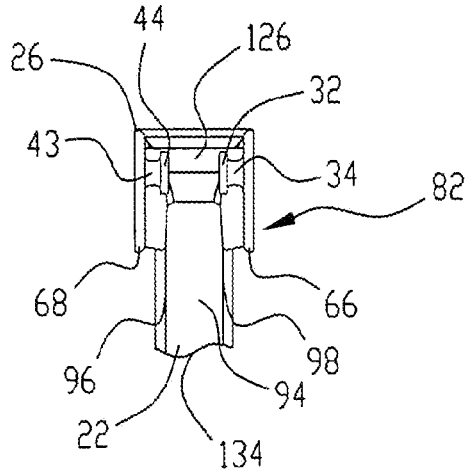
FIG. 9 is an end view of the flared end of the clamping ring of FIG. 7.

FIGS. 7-9 illustrates the top, side partial cross section, and end views of ring 82 second end 26. Ring second end 26 includes a flared region with inwardly facing sidewalls, a first sidewall 68 having an inwardly extending boss comprising pivot boss shaft 43 and pivot button 44. A similar boss comprising pivot shaft 34 and pivot button 32 extends inwardly from the ring second end 26 opposite sidewall 66 as shown in FIG. 7. As shown in partial cross section in FIG. 8, an inwardly facing transverse beam 126 extends between sidewall 66 and sidewall 68.

Figure 11:
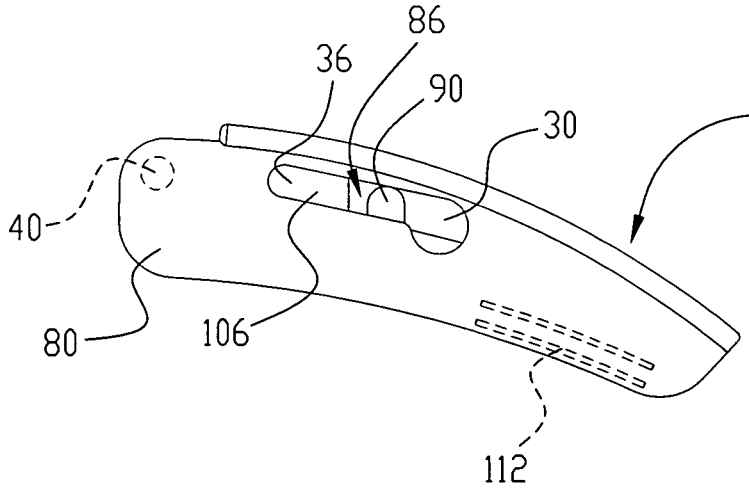
FIG. 11 is a side view of the lever of FIG. 10.
Figure 12:
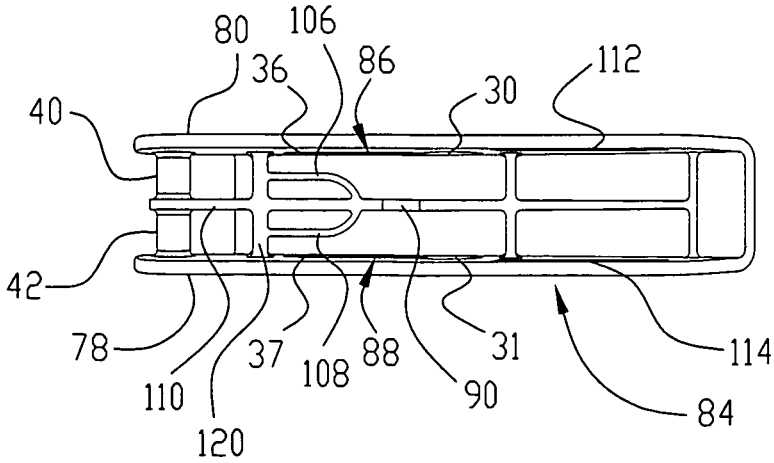
FIG. 12 is a bottom view of the lever of FIG. 10.

FIGS. 10-12 illustrate the top, side, and bottom views of lever 84 having an inward opening generally U-shaped channel form having opposing sidewalls, a first sidewall 80 and a second sidewall 78 slightly flared outward toward the lever bottom such that the inwardly facing internal surfaces are slideably moveable over the outer surfaces of ring 82 first end 38. Sidewall 80 having an inwardly extending pivot shaft 40, and sidewall 78 having an inwardly extending pivot shaft 42 which meet at an inwardly facing longitudinal pivot beam 110.

FIG. 11 depicts a keyhole shaped pivot boss receiving window 86 having pivot boss access opening 30 and a longitudinally extending pivot shaft bearing surface 36 projecting through sidewall 80. Opening 30 is sized to pass the boss button 44 depicted in FIG. 7 while the narrow slot portion 36 will pass boss shaft 43 but not the larger diameter of button 44. An analogous keyhole shaped pivot boss receiving window 88 having pivot boss access opening 31 and a longitudinally extending pivot shaft bearing surface 37 projecting through sidewall 78 is shown in FIG. 12.

FIG. 12 reveals an inwardly extending transverse beam 120 extending between the internal surfaces of sidewall 80 and sidewall 78. The lever having a first inwardly extending pivot boss alignment rib 106 and a second inwardly extending pivot boss alignment rib 108. The lever having a first inwardly extending pair of detent ribs 112 from sidewall 80 and a second inwardly extending pair of detent ribs 114 from sidewall 78.

Figure 13:
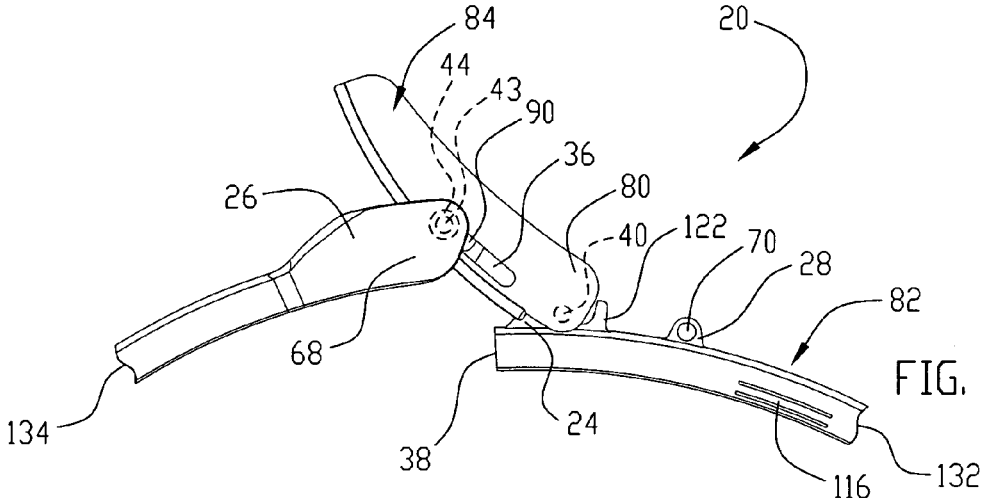
FIG. 13 is a partial side view of the two piece clamping ring and lever assembly of the invention showing an open orientation thereof.
Figure 14:
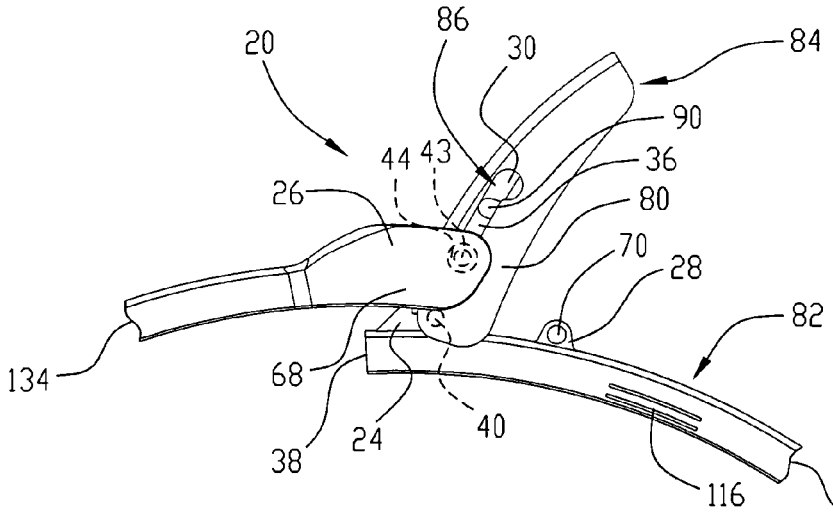
FIG. 14 is a partial side view of the clamping ring assembly of FIG. 13 showing its orientation while being closed.
Figure 15:
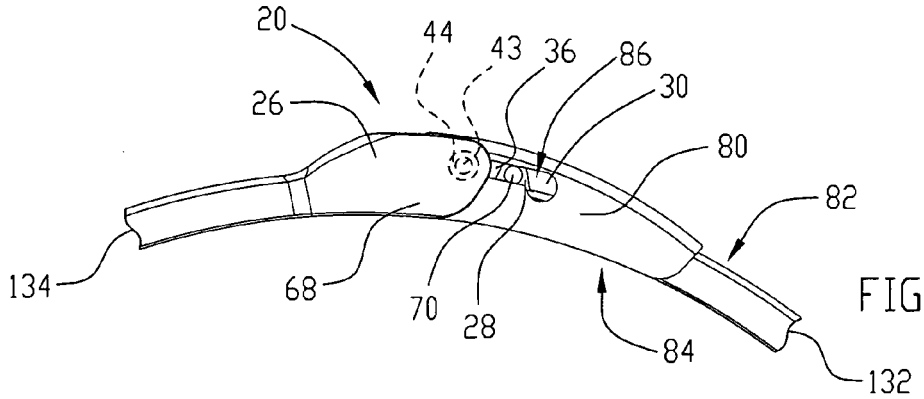
FIG. 15 is a partial side view of the clamping ring assembly of FIG. 13 showing its orientation while closed.

FIGS. 13-15 illustrate the orientations of the two piece polymer clamping ring assembly depicted generally at 20 when manipulated from an open to a closed orientation. FIG. 13 illustrates the orientation of the clamping ring assembly 20 as shown in the generally open orientation assumed during the procedure of installing it upon the container rim and lid interface of the container assembly 102. Ring 82 having ends 132 and 134 extend and join with one another such that ring 82 depicted in FIG. 13 is a single piece except for the break between ends 38 and 26. FIG. 13 shows lever pivot shaft 40 has been inserted through the ring first end 38 pivot receiver opening 76 and into the corresponding receiving hook 24. It is noted that a second lever pivot shaft 42 is simultaneously inserted through pivot receiver opening 77 and into the corresponding receiving hook 25. The diameter of receiving hooks 24 and 25 having a slightly smaller diameter than pivot shafts 40 and 42 will exhibit a resilient give as pivot shafts 40 and 42 are inserted, thus capturing lever pivot shafts 40 and 42 in pivotable engagement with the respective receiving hooks 24 and 25 on the ring first end 38.

Sidewall 68 of ring second end 26 has an inwardly extending boss comprising pivot boss shaft 43 and pivot button 44. A similar boss comprising pivot shaft 34 and pivot button 32 extends inwardly from the ring second end 26 opposite sidewall 66 as shown in FIG. 7. Lever 84 is joined with ring 82 second end 26 by flexing the sidewalls 66 and 68 away from one another sufficiently to slide the pivot bosses along the lever sidewalls 78 and 80 until the buttons 32 and 44 can enter their respective access openings 31 and 30. When the first and second pivot boss buttons are engaged in the corresponding access openings on the lever the ring 82 second end 26 sidewalls 66 and 68 will straighten thereby allowing the pivot boss shaft 34 and pivot boss shaft 43 to slideably engage the corresponding lever pivot boss bearing surfaces 37 and 36 respectively.

Comparing FIGS. 14 and 15, FIG. 14 shows the lever extending from the ring in a generally radial direction. Movement of the lever from that position to a generally tangential direction as depicted in FIG. 15 draws the ring ends 38 and 26 into an overlapping position with the flared end of the ring 26 spanning lever 84 and lever sidewall 78 and 80 spanning the ring first end 38. FIG. 15 shows the two piece polymer clamping ring 20 in a closed position and lever detent ribs 112 and 114 are now engaged frictionally with the respective ring detent ribs 116 and 118, and lockpin lug 28 aperture 70 is shown in alignment with the corresponding lever lockpin aperture 90 such that a seal or lockpin device can be inserted into the closed lever to provide means of security for the container assembly.

Figure 16:
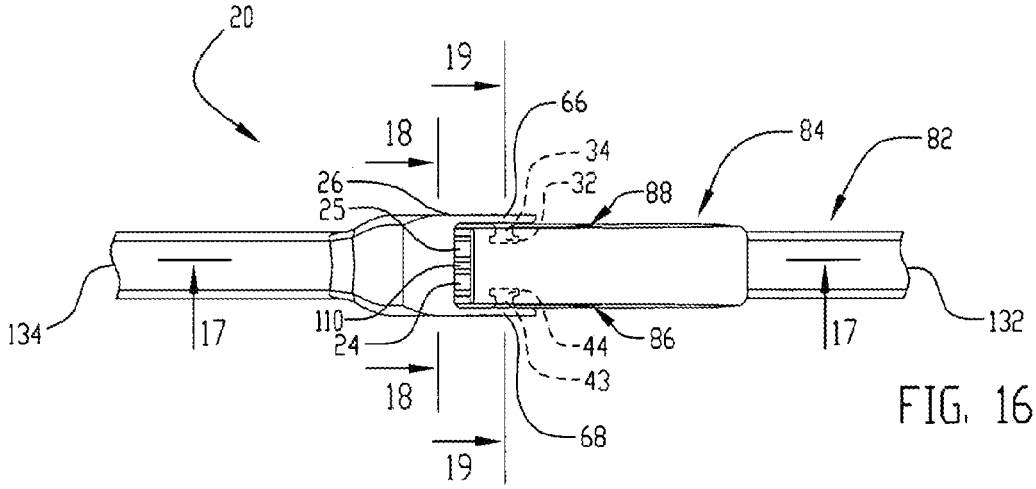
FIG. 16 is a partial side view of the two piece clamping ring and lever assembly of the invention showing the lever thereof.
Figure 17:
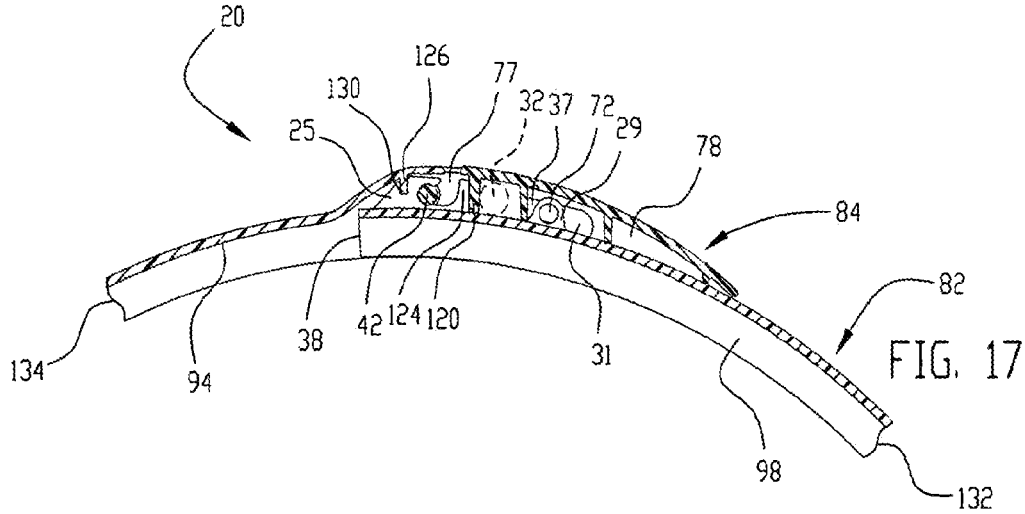
FIG. 17 is a sectional view taken through the plane 17-17 in FIG. 16.

FIG. 16 depicts a partial top view of closed ring assembly 20 revealing the position of the ring second end 26 pivot bosses as assembled to the lever. A partial cross section illustrated in FIG. 17 details the internal geometry of ring assembly 20 in the closed position. The lever 84 transverse rib 120 is shown abutted to ring first end 38 stress transfer beam 124 which transfers stresses away from lever pivot pin 42 and ring first end receiving hook 25. In similar fashion the inwardly extending stress transfer beam of ring second end 26 is engaged in the corresponding receiving channel 130 of the ring first end 38, thereby relieving stress from the ring second end pivot bosses 34 and 43.

Figure 18:
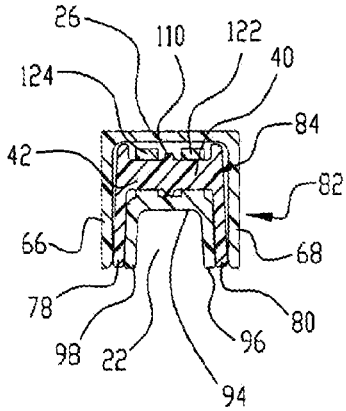
FIG. 18 is a sectional view taken through the plane 18-18 in FIG. 16.

FIG. 18 depicts a cross-sectional view through the axis of the lever 84 pivot shafts 40 and 42, looking generally in the tangential direction. Here the lever longitudinal pivot beam 110 can be seen centrally connecting pivot shafts 40 and 42. Longitudinal pivot beam 110 provides significant strength characteristics to pivot shafts 40 and 42 by transferring the stresses imparted on the pivot shafts through the center of the lever. An additional benefit of longitudinal pivot beam 110 is to provide a flow channel to resin during the component molding process thereby ensuring that the pivot shafts do not contain a resin knit line as can happen with a transverse pivot shaft.

Figure 19:
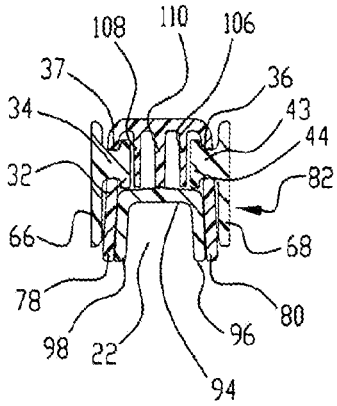
FIG. 19 is a sectional view taken through the plane 19-19 in FIG. 16.
Figure 16A:
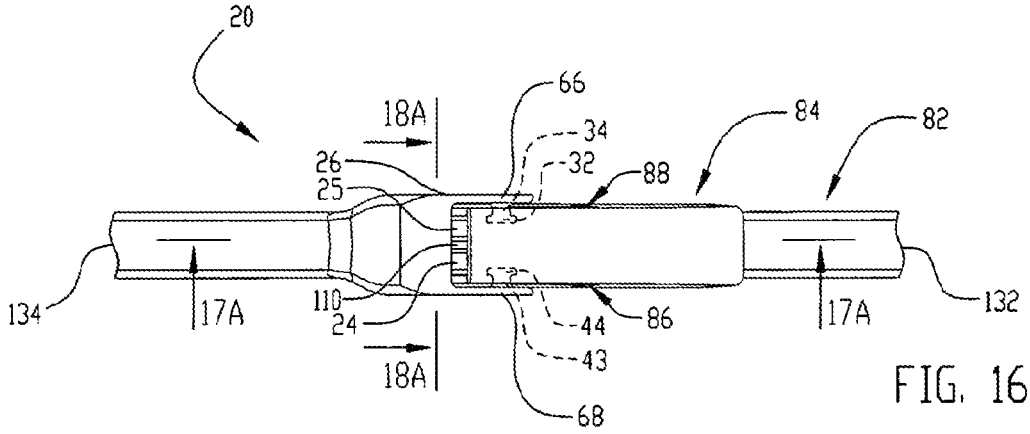
FIG. 16A is a partial side view of a second embodiment of the two piece clamping ring and lever assembly of the invention showing the lever thereof.

FIG. 19 is a cross-sectional view through the axis of the ring second end 26 pivot bosses 34 and 43 again looking in a generally tangential direction. In this view lever 84 pivot boss alignment ribs 106 and 108 can be seen adjacent to their respective pivot boss button 44 and 32. These alignment ribs 106 and 108 create a secondary capture region for each pivot button acting in slideable engagement with the flat surface of pivot buttons 44 and 32 thus preventing the pivot buttons from twisting outward under stress and pulling through the longitudinal pivot boss bearing surface when the ring is in tension. The independent slideable engagements between the ring pivot bosses and the lever are an important feature which allows the assembly to withstand stresses imparted during container tip over and drops.

FIGS. 16A-18A illustrate a portion of a two piece clamping ring in accordance with a second embodiment of the invention. For simplicity, elements that are the same as those in the embodiment of FIGS. 1-19 are illustrated with the same reference numerals. Likewise for simplicity only the portion of the lever pivot mechanism is illustrated as the remainder of the two piece polymer clamping ring is identical in this embodiment.

Figure 17A:
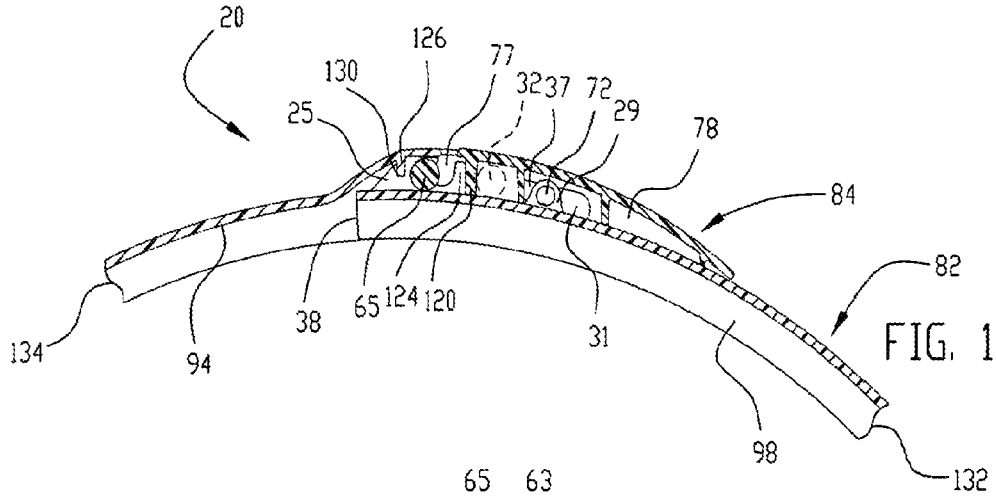
FIG. 17A is a sectional view taken through the plane 17A-17A in FIG. 16A.
Figure 18A:
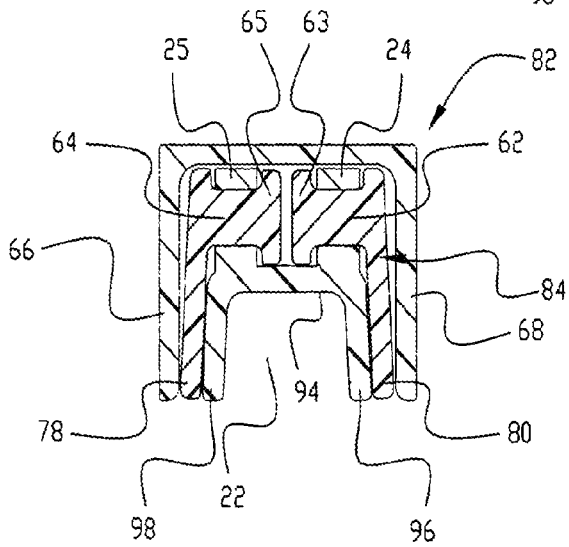
FIG. 18A is a sectional view taken through the plane 18A-18A in FIG. 16A.

FIG. 18A illustrates a cross-sectional view looking in a generally tangential direction through the axis of the pivot end lever 84 showing inwardly projecting pivot bosses 62 and 64 and their respective pivot buttons 63 and 65. Pivot bosses 62 and 64 are configured for pivotal engagement with the ring first end 38 receiving hooks 24 and 25. FIG. 17A depicts a cross-sectional view longitudinally through lever 84 and ring first end 38 and second end 26, revealing the larger diameter of lever pivot boss button 65.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

I claim:

1. A two piece clamping ring and lever system for retaining removable lids to containers, comprising:

a split circular ring, having an inwardly opening U-shaped channel, having first and second ends, an outer circumferential wall and oppositely disposed inwardly facing sidewalls, said ring first end including a plurality of outwardly extending receiving hooks, a plurality of outwardly facing receiving channels, and a plurality of outwardly extending stress transfer beams; said ring having an oppositely disposed second end including a flared region with mutually inwardly facing internal surfaces slideably moveable in adjacency over the outwardly facing side surfaces of a lever, the inwardly facing sidewalls of said ring second end including inwardly extending pivot bosses comprising a pivot shaft and enlarged pivot button; and a lever having an inwardly opening U-shaped channel, having mutually inwardly facing internal surfaces slideably moveable in adjacency over the side surfaces of the ring first end, said lever having a pivot end formed with a plurality of pivot shafts inwardly extending from the spaced apart sides of the lever to a pivot beam longitudinally disposed about the center of the lever underside, said lever having a plurality of receiving windows projecting through oppositely disposed lever sidewalls comprising ring second end pivot boss access openings connected to longitudinally extending ring second end pivot shaft bearing surfaces, said ring second end pivot shaft bearing surfaces spaced from the lever pivot shafts a distance selected for drawing together the ring first and second ends as said lever is moved from a radial position to a tangential position during closing of the clamping ring, said lever pivot shafts are configured for pivotable engagement with the ring first end receiving hooks and the lever receiving windows are configured for slideably receiving the ring second end pivot bosses.

2. The two piece clamping ring and lever system of claim 1 in which:

said inwardly facing sidewalls of said ring second end include an inwardly facing transverse beam extending between said sidewalls; and said ring first end outwardly extending receiving hooks are configured with outwardly facing receiving channels, said ring second end inwardly facing transverse beam configured to engage said ring first end outwardly facing receiving channels in a stress transfer relationship as said lever is moved from a radial position to a tangential position during closing of the clamping ring, thereby relieving stresses on said ring second end pivot bosses and said lever corresponding pivot shaft bearing surface.

3. The two piece clamping ring and lever system of claim 1 wherein:

said lever having an inwardly facing transverse beam between said spaced apart sides of said lever, configured to engage said ring first end outwardly extending stress transfer beams in a stress transfer relationship as said lever is moved from a radial position to a tangential position during closing of the clamping ring, thereby relieving stresses on said lever pivot shafts and said ring first end pivot receiving hooks.

4. The two piece clamping ring and lever system of claim 1 wherein:

said lever comprises a plurality of pivot boss alignment ribs extending longitudinally from said inwardly facing transverse beam, centrally connected to said lever longitudinal pivot beam, said pivot boss alignment ribs configured to provide a secondary capture region for said ring second end pivot button, acting in slideable engagement with the inwardly disposed surfaces of said ring second end pivot buttons for slideably retaining said pivot buttons when the clamping ring system is exposed to dynamic shock conditions.

5. A two piece clamping ring and lever system for retaining removable lids to containers, comprising:

a split circular ring, having an inwardly opening U-shaped channel, having first and second ends, an outer circumferential wall and oppositely disposed inwardly facing sidewalls, said ring first end including a plurality of outwardly extending receiving hooks, a plurality of outwardly facing receiving channels, and a plurality of outwardly extending stress transfer beams; said ring having an oppositely disposed second end including a flared region with mutually inwardly facing internal surfaces slideably moveable in adjacency over the outwardly facing side surfaces of a lever, the inwardly facing sidewalls of said ring second end including inwardly extending pivot bosses comprising a pivot shaft and enlarged pivot button; and a lever having an inwardly opening U-shaped channel, having mutually inwardly facing internal surfaces slideably moveable in adjacency over the side surfaces of the ring first end, said lever having a pivot end comprising of oppositely disposed spaced apart sides having inwardly projecting pivot bosses comprising a pivot shaft and enlarged button, said lever having a plurality of receiving windows projecting through oppositely disposed lever sidewalls comprising ring second end pivot boss access openings connected to longitudinally extending ring second end pivot shaft bearing surfaces, said ring second end pivot shaft bearing surfaces spaced from the lever pivot bosses a distance selected for drawing together the ring first and second ends as said lever is moved from a radial position to a tangential position during closing of the clamping ring, said lever pivot bosses are configured for pivotable engagement with the ring first end receiving hooks and the lever receiving windows are configured for slideably receiving the ring second end pivot bosses.

6. The two piece clamping ring and lever system of claim 5 in which:

said inwardly facing sidewalls of said ring second end include an inwardly facing transverse beam extending between said sidewalls; and said ring first end outwardly extending receiving hooks are configured with outwardly facing receiving channels, said ring second end inwardly facing transverse beam configured to engage said ring first end outwardly facing receiving channels in a stress transfer relationship as said lever is moved from a radial position to a tangential position during closing of the clamping ring, thereby relieving stresses on said ring second end pivot bosses and said lever corresponding pivot shaft bearing surface.

7. The two piece clamping ring and lever system of claim 5 wherein:

said lever having an inwardly facing transverse beam between said spaced apart sides of said lever, configured to engage said ring first end outwardly extending stress transfer beams in a stress transfer relationship as said lever is moved from a radial position to a tangential position during closing of the clamping ring, thereby relieving stresses on said lever pivot bosses and said ring first end pivot receiving hooks.

8. The two piece clamping ring and lever system of claim 7 wherein:

said lever comprises a plurality of pivot boss alignment ribs extending longitudinally from said inwardly facing transverse beam, centrally connected to said lever longitudinal beam, said pivot boss alignment ribs configured to provide a secondary capture region for said ring second end pivot button, acting in slideable engagement with the inwardly disposed surfaces of said ring second end pivot buttons for slideably retaining said pivot buttons when the clamping ring system is exposed to dynamic shock conditions.

9. In a container assembly wherein a cylindrical container is provided having a bottom and cylindrical sidewalls extending to an annular end portion defining a top opening and a removable lid overlying said opening, a two piece clamping ring and lever system for retaining said removable lids to containers, comprising:

a split circular ring, having an inwardly opening U-shaped channel, having first and second ends, an outer circumferential wall and oppositely disposed inwardly facing sidewalls, said ring first end including a plurality of outwardly extending receiving hooks, a plurality of outwardly facing receiving channels, and a plurality of outwardly extending stress transfer beams; said ring having an oppositely disposed second end including a flared region with mutually inwardly facing internal surfaces slideably moveable in adjacency over the outwardly facing side surfaces of a lever, the inwardly facing sidewalls of said ring second end including inwardly extending pivot bosses comprising a pivot shaft and enlarged pivot button; and a lever having an inwardly opening U-shaped channel, having mutually inwardly facing internal surfaces slideably moveable in adjacency over the side surfaces of the ring first end, said lever having a pivot end formed with a plurality of pivot shafts inwardly extending from the spaced apart sides of the lever to a pivot beam longitudinally disposed about the center of the lever underside, said lever having a plurality of receiving windows projecting through oppositely disposed lever sidewall s comprising ring second end pivot boss access openings connected to longitudinally extending ring second end pivot shaft bearing surfaces, said ring second end pivot shaft bearing surfaces spaced from the lever pivot shafts a distance selected for drawing together the ring first and second ends as said lever is moved from a radial position to a tangential position during closing of the clamping ring, said lever pivot shafts are configured for pivotable engagement with the ring first end receiving hooks and the lever receiving windows are configured for slideably receiving the ring second end pivot bosses.

10. The container assembly with the two piece clamping ring and lever system of claim 9, wherein said inwardly facing sidewalls of said ring second end include an inwardly facing transverse beam extending between said sidewalls; and wherein said ring first end outwardly extending receiving hooks are configured with outwardly facing receiving channels, said ring second end inwardly facing transverse beam configured to engage said ring first end outwardly facing receiving channels in a stress transfer relationship as said lever is moved from a radial position to a tangential position during closing of the clamping ring, thereby relieving stresses on said ring second end pivot bosses and said lever corresponding pivot shaft bearing surface.

11. The container assembly with the two piece clamping ring and lever system of claim 9 wherein:

said lever having an inwardly facing transverse beam between said spaced apart sides of said lever, configured to engage said ring first end outwardly extending stress transfer beams in a stress transfer relationship as said lever is moved from a radial position to a tangential position during closing of the clamping ring, thereby relieving stresses on said lever pivot shafts and said ring first end pivot receiving hooks.

12. The container assembly with the two piece clamping ring and lever system of claim 11 wherein:

said lever comprises a plurality of pivot boss alignment ribs extending longitudinally from said inwardly facing transverse beam, centrally connected to said lever longitudinal pivot beam, said pivot boss alignment ribs configured to provide a secondary capture region for said ring second end pivot button, acting in slideable engagement with the inwardly disposed surfaces of said ring second end pivot buttons for slideably retaining said pivot buttons when the clamping ring system is exposed to dynamic shock conditions.

* * * * *